US006357212B1

(12) United States Patent
Salm et al.

(10) Patent No.: US 6,357,212 B1
(45) Date of Patent: Mar. 19, 2002

(54) APPARATUS FOR FORMING CARTONS FROM BLANKS AND FOR SIMULTANEOUSLY FILLING THE CARTONS

(75) Inventors: Thomas Salm, Aachen; Bernfried Kutsch, Stollberg, both of (DE)

(73) Assignee: Winkler & Duennebier AG (DE)

( * ) Notice: Subject to any disclaimer, the term of this patent is extended or adjusted under 35 U.S.C. 154(b) by 0 days.

(21) Appl. No.: 09/389,253

(22) Filed: Sep. 3, 1999

(30) Foreign Application Priority Data

Sep. 3, 1998 (DE) ..... 198 40 077

(51) Int. Cl.[7] ..... B65B 3/02

(52) U.S. Cl. ..... 53/558; 53/140; 53/376.4

(58) Field of Search ..... 53/140, 558, 376.4, 53/376.5, 377.4, 382.1, 382.2, 382.3, 116, 117, 569, 574, 301; 493/70, 80, 183

(56) References Cited

U.S. PATENT DOCUMENTS

| | | | | | |
|---|---|---|---|---|---|
| 2,605,598 | A | * | 8/1952 | MacKenzie | 493/183 |
| 3,067,556 | A | * | 12/1962 | Neer | 53/491 |
| 3,466,838 | A | * | 9/1969 | Sorensen et al. | 493/114 |
| 3,485,007 | A | * | 12/1969 | MacKendrick | 53/491 |
| 3,585,776 | A | * | 6/1971 | Euwe | 53/207 |
| 3,821,874 | A | * | 7/1974 | Jones | 53/27 |
| 4,414,789 | A | * | 11/1983 | Pattarozzi | 53/566 |
| 4,543,767 | A | * | 10/1985 | Wiseman | 53/76 |
| 4,569,182 | A | * | 2/1986 | Leuvering | 53/456 |
| 4,569,184 | A | * | 2/1986 | Strombeck | 53/564 |
| 4,570,421 | A | * | 2/1986 | Focke et al. | 53/491 |
| 4,662,150 | A | * | 5/1987 | Johnson et al. | 53/481 |
| 4,798,571 | A | * | 1/1989 | Everman et al. | 493/114 |
| 5,511,362 | A | * | 4/1996 | Morita et al. | 53/491 |
| 5,729,954 | A | * | 3/1998 | Lines et al. | 53/381.7 |
| 6,113,525 | A | * | 9/2000 | Waechter | 493/183 |

FOREIGN PATENT DOCUMENTS

| | | |
|---|---|---|
| DE | G 9208784 | 10/1992 |
| DE | 19636262 | 3/1998 |

* cited by examiner

*Primary Examiner*—Peter Vo
*Assistant Examiner*—John Paradiso
(74) *Attorney, Agent, or Firm*—W. F. Fasse; W. G. Fasse

(57) ABSTRACT

A box folding and article packaging apparatus has a lower tool section positioned below a work support surface and several upper tool sections positioned above the work support surface. The lower tool section includes four modular corner units each with folding flaps and a fixed support element. The four support elements together define the work support surface. The four corner units are displaceable relative to each other for adapting the apparatus for handling blanks of different sizes. A precut and precreased blank is first placed on the work support surface. The article to be packaged is then placed on the blank whereupon folding begins. One upper tool section also includes folding elements for folding a cover portion of a box and closing the box. Another upper tool section includes either adhesive applicators or staplers or the like for fastening folded blank sections to one another to complete the carton around the article or articles.

15 Claims, 17 Drawing Sheets

APPARATUS FOR FORMING CARTONS FROM BLANKS AND FOR SIMULTANEOUSLY FILLING THE CARTONS

This application is based on and claims the priority under 35 U.S.C. §119 of German Patent Application 198 40 077.2, filed on Sep. 3, 1998, the entire disclosure of which is incorporated herein by reference.

1. Field of the Invention

The invention relates to an apparatus for packaging of articles or stacks of articles such as letter envelopes, whereby the apparatus simultaneously forms the cartons from precut and precreased blanks.

2. Background Information

It is known to use precut and precreased blanks for making cartons. Such blanks, also referred to as folding box blanks, are initially flat and include the following sections, a bottom section, two side wall sections, a number of end wall sections, and at least one cover section and connector tabs possibly including corner connector tabs. These sections and tabs are interconnected along folding lines, each provided with a respective precrease or indentation. When such a flat blank has been inserted into the carton folding machine, an article or a stack of articles is set onto the bottom section and the side and end wall sections are folded against the article or a stack of articles. More specifically, the side wall and end wall sections and the tabs are folded upwardly or folded over. For this purpose the folding machine has a work support surface for the flat blank and lower and upper tool sections. A lower tool section is positioned in its starting location below the work support surface. The lower tool section is equipped with blank side folding flaps that are displaceable into a working position reaching above the work support surface. These flaps include lateral wall folding flaps, end wall folding flaps, and further folding flaps each provided with respective drives. An upper tool section includes a device for folding over the carton cover and the connector tabs. A further upper tool section such as an adhesive applicator provides adhesive on the folded blank and connector tabs for fixing the sections to one another to finish the box.

German Utility Model Publication DE 92 08 784 U describes an apparatus as described above. In the known apparatus the entire folding operation is performed by a lower tool section which has two side folding plates driven by a common drive. A cover folding flap is journalled to each of the side folding plates. Each cover folding flap is equipped with a respective cover folding flap drive. The end wall sections are lifted up by strikers movable upwardly above the work support surface along a straight upwardly slanted line. Instead of the strikers end wall folding flaps can be used. Stapling devices allocated to the four corner areas of the box are used for fixing the folded blank sections into a box shape. The stapling devices simultaneously lay stapling tabs against the stack to be packaged.

The lower tool section in the known apparatus for packaging letter envelopes is mounted in a fixed position in a machine frame and the folding flaps can only be tilted, but are not position adjustable. As a result, the known apparatus can handle only precut blanks of a predetermined size. This limitation entails another limitation in the size of the articles or stacks of articles to be packaged which is also limited to the given size of the precut blank.

German Patent Publication DE 196 36 262 A1 discloses an apparatus for producing of folding boxes from precut blanks. Four corner folding tools form corner modular units one of which is allocated to each of the four corner points of the bottom section of the blank, for lifting the side wall sections and the end wall sections. These modular units are supported on a rectangular frame including two longitudinal carrier beams and two cross carrier beams. The spacing between the cross beams and the spacing between the longitudinal beams are variable with the aid of laterally positioned adjustment spindles, whereby an adaptation of the apparatus to blanks having bottom sections of different sizes becomes possible. The fixing of the raised lateral and end walls in their box forming positions is accomplished by applying adhesive to respective bonding tabs.

The just mentioned known apparatus is not used for simultaneously packaging articles or stacks of articles. Rather, the folding boxes are formed in the apparatus for a subsequent filling at another location. For this purpose the folding boxes remain first open and accordingly cover folding flaps are not provided. Besides, the known apparatus applies an over-stretching of precut blank flaps which are pressed into the already partly finished box in order to keep these flaps in a lifted position after release of the tools. Thus, it is not possible to further develop the known apparatus in such a way that an article or stacks of articles can be enclosed by the blank as the blank is being folded into a box.

Incidentally, the terms article as used in the following text is intended to mean a single article, a plurality of articles, a stack of articles or a plurality of article stacks.

OBJECTS OF THE INVENTION

In view of the foregoing it is the aim of the invention to achieve the following objects singly or in combination:

- to improve an apparatus of the type first described above in such a way that an article can be packaged in a folding box blank by simple means in a safe and reliable manner, and so that the folding box blanks may have different sizes and configurations to package articles of different sizes, in boxes of different sizes on the same machine;
- to enclose an article in a box already during the folding of the box;
- to accommodate various sizes of precut blanks by a simple adjustment of the position of blank folding modular tool units in the folding and packaging machine; and
- to allocate box forming functions to a lower tool section while cover forming functions and box section fixing functions are performed by an upper tool section.

SUMMARY OF THE INVENTION

The above objects have been achieved according to the invention by a lower tool section that is characterized by four lower modular tool units allocated to the four corner points of a bottom section of a precut carton blank on a work or blank support surface formed by the lower tool section. Each modular tool unit including its folding flaps is mounted in such a way in the lower tool section that the positions of the modular tool units are adjustable in pairs in a longitudinal direction and in a cross direction for adaptation to blank bottom sections of various sizes, and in that the lower tool section with all its modular units is movable by a drive either linearly back and forth on a horizontal guide or rotationally about an axis extending orthogonally to the work support surface or both linearly and rotationally and/or up and down.

By using four corner modular tool units in combination with the position adjustability of these units individually relative to each other the apparatus according to the invention can be adapted to handling precut blanks having bottom sections of different sizes. Further, the linear or rotational movability of the lower tool section, particularly the rotatability or tiltability of the lower tool section, with all its units and components including its work support surface, makes it possible to properly position an unfinished box relative to the upper tool section or sections including a fixing device such as adhesive nozzles for completing the box. According to the invention, it is now possible to selectively supply the precut blanks of different sizes in coordination with the packaging of articles of different sizes. The removal of finished packages in the desired direction has also been facilitated.

Especially the division of the packaging apparatus according to the invention into a lower tool section that forms the box proper and into an upper tool section that forms the box cover has the advantage that the versatility and useability of the apparatus is increased, whereby the present apparatus is useable for various types of packaging operations and various types of packages. Moreover, the entire apparatus becomes less complicated by the division into lower and upper tool sections which are more easily seen and accessible, e.g. for maintenance work. The respective functions of folding the box and forming the cover are also separated whereby the operational safety and the capacity of the apparatus are further improved.

It is especially advantageous if the lower tool section in addition to its rotational motion can be linearly displaced in the machine frame either up and down or back and forth, whereby the work support surface can be properly oriented in the vertical and horizontal directions. The vertical or elevational positioning makes it possible to handle boxes of different heights and present the unfinished boxes in the proper position to the upper box finishing tool sections, especially the adhesive nozzles and the upper folding tool section. The horizontal adjustability on the other hand makes it possible in a simple way to package two articles or two stacks of articles next to one another on a single blank bottom, whereupon the blank is folded and the box finished.

BRIEF DESCRIPTION OF THE DRAWINGS

In order that the invention may be clearly understood it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
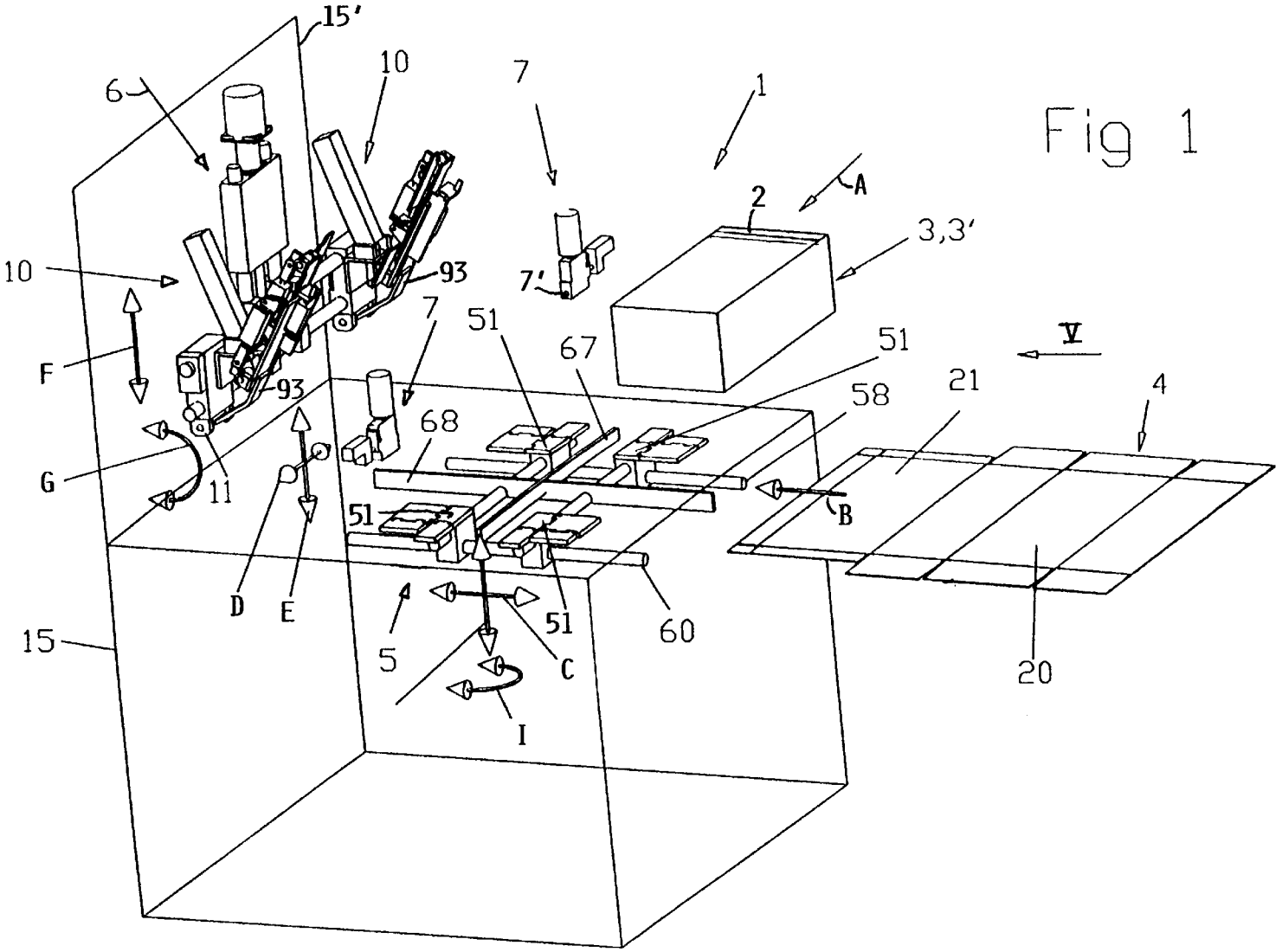
FIG. 1 is a simplified perspective view of an apparatus according to the invention illustrating the relative position of essential components.

FIG. 1 shows an apparatus 1 for packaging articles 2 that can be formed as a stack 3 or as a single article 3'. In both instances the article is moved in the direction of the arrow A onto a blank or work supporting surface 51 to be described in more detail below. Lead lines with one half of an arrow tip lead to a surface. The blank or work supporting surface 51 is formed by support elements 51", one of which is part of each of four corner modular units 51'. The surface 51 is augmented by top edges of support bars 67 and 68. Precut and precreased folding box blanks 4 are supplied, for example by a conveyor not shown. The blanks 4 advance in the direction of the arrow B onto the blank supporting surface 51.

Figure 5:
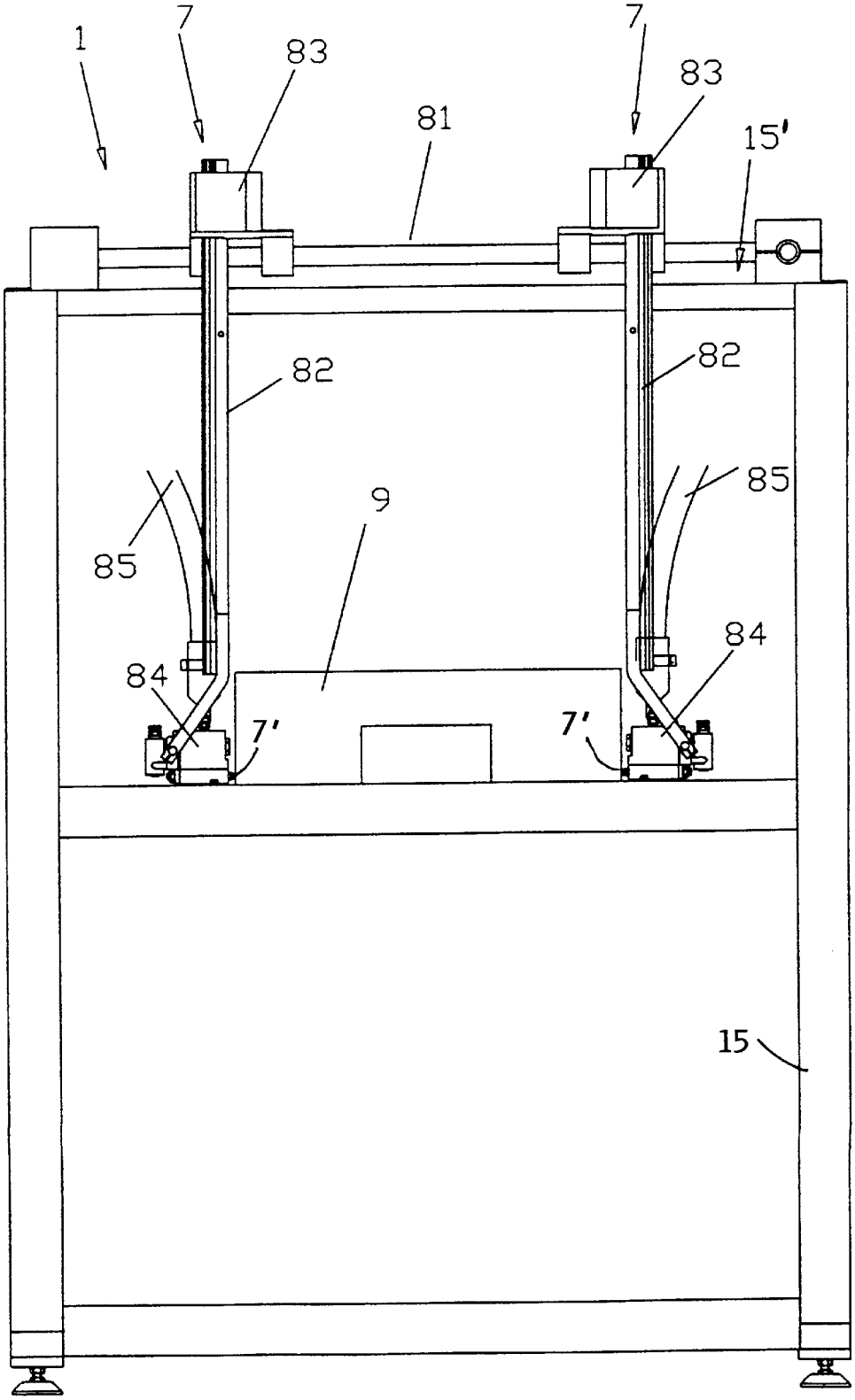
FIG. 5 shows on an enlarged scale an elevational view in the direction of the arrow V in FIG. 1.

FIG. 1 further shows that the modular corner units 51' form part of a lower tool section 5 which is at least movable linearly from its shown starting position back and forth horizontally as indicated by the double arrow C. The lower tool section 5 is operatively mounted in a machine frame 15 that has an extension 15' carrying an upper tool section 6 and also one or more further upper tool sections 7, for example in the form of adhesive dispensers having adhesive dispensing nozzles 7'. The connections between the frame extension 15' and the adhesive applicators 7 are shown in FIG. 5. The adhesive applicators 7 may be replaced by one or more stapling mechanisms which as such are conventional.

Figure 10:
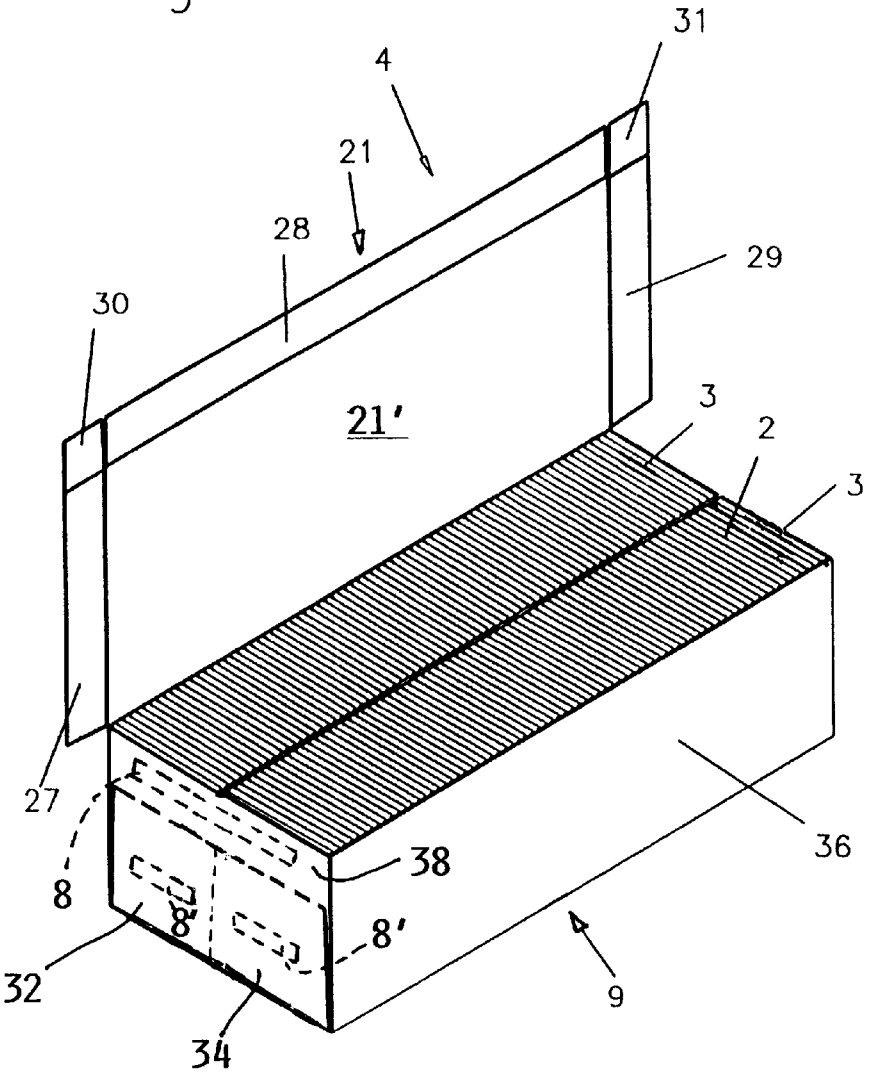
FIG. 10 shows a perspective view of a box filled with two rows or stacks of letter envelopes, whereby the folding box has a flap cover with cover rims that reach over the upper edges of the side and end walls of the box.

According to FIG. 1, the folding box blank 4 is being supplied from a magazine, for example in the direction of the arrow B to be placed on the blank supporting surface 51 while the article 3 is moved in the direction of the arrow A for placement on the bottom section 20 of the blank 4 as soon as the blank 4 has assumed its proper position on the surface 51 formed by the support elements 51" and by the support bars 67, 68 of the lower tool section 5. The lower tool section 5 is movable in the direction of the double arrow C to enable the applicators 7 to apply adhesive to areas 8, 8' of a not yet finished folding box 9 folded of the blank 4. Glue or adhesive is applied to the proper areas 8, 8' of the not yet finished box 9 as it moves past the nozzles 7'. These areas 8, 8' are seen in FIG. 10.

The adhesive applicators 7 or staplers are movable horizontally back and forth in the direction of the double arrow D toward and away from the unfinished box 9. Further, the applicators 7 or staplers are movable vertically relative to the unfinished box 9 for adjustment of the adhesive application level as indicated by the double arrow E.

The two applicator half sections 7 are arranged mirror-symmetrically relative to each other. Similarly, the upper tool section 6 also comprises two mirror-symmetrically arranged half sections 10. These tool half sections 10 are movable in unison vertically up and down as indicated by the arrow F. Further, the half units 10 are journalled for tilting about an axis 11 as indicated by the double arrow G. The two half sections 10 of the upper tool section 6 are, for example manually adjustable along guide bars 12 and 13 shown as a pair in FIG. 6. For this purpose the half tool sections 10 are mounted on the guide bars 12, 13 by support slide blocks 14 that are displaceable and adjustable along the guide bars 12 and 13.

FIG. 1 shows the machine frame 15, 15' merely schematically. All components shown in FIG. 1 are operatively mounted in the machine frame 15, 15'. The supply mechanism for the articles 3, 3' and the supply mechanism for feeding blanks 4 to the folding apparatus are not shown in FIG. 1 to simplify the illustration. These supply mechanisms are conventional.

Figure 11:
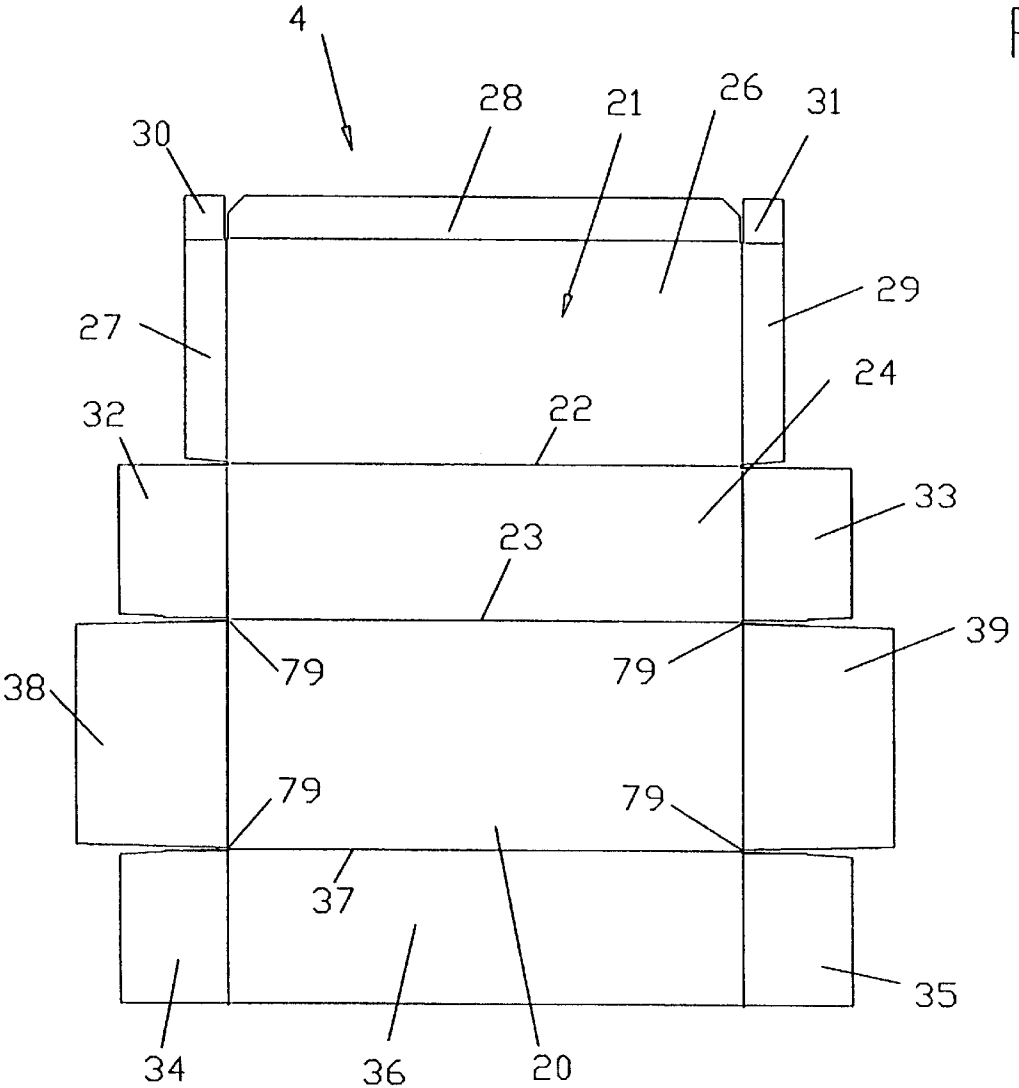
FIG. 11 is a plan view of a folding box precut blank for forming the folding box of FIG. 10.

Referring to FIGS. 10 and 11 the single piece folding box blank 4 to be folded into a not yet finished box 9 in the apparatus 1, comprises a bottom section 20, a cover section 21 separated by a side wall section 24 from the bottom section 20. Precreases 23 and 22 separate the side wall section 24 from the bottom section 20 and from the cover section 21 respectively. The cover section 21 comprises, on the one hand, a cover portion 21' and rim sections 27, 28 and 29 connected to the cover portion 21' through respective folding precreases. The rim sections are provided with corner tabs 30 and 31 connected through precreased folding lines with the two short or end wall rim sections 27 and 29. FIG. 10 shows in dashed lines the areas 8, 8' to which adhesive is to be applied by the above mentioned nozzles 7'. Adhesive in the area 8 will connect rim section 27 to the tab 38 forming part of a box end wall. Adhesive in the areas 8' between the tab 38 and the tabs 32, 34 connects these tabs to each other.

FIG. 11 also shows lateral connector tabs 32 and 33 for forming end walls. These tabs are provided on the side wall section 24. Further, lateral connector tabs 34 and 35 for forming end walls are provided at the outer ends of a second side wall section 36 that itself is connected through a folding precrease 37 with the bottom section 20. Further lateral connector tabs 38 and 39 are provided at the ends of the bottom section 20 and connected to the bottom section 20 through respective fold lines just as is the case for the other lateral connector tabs and the respective side wall forming sections 24 and 36.

Figure 13:
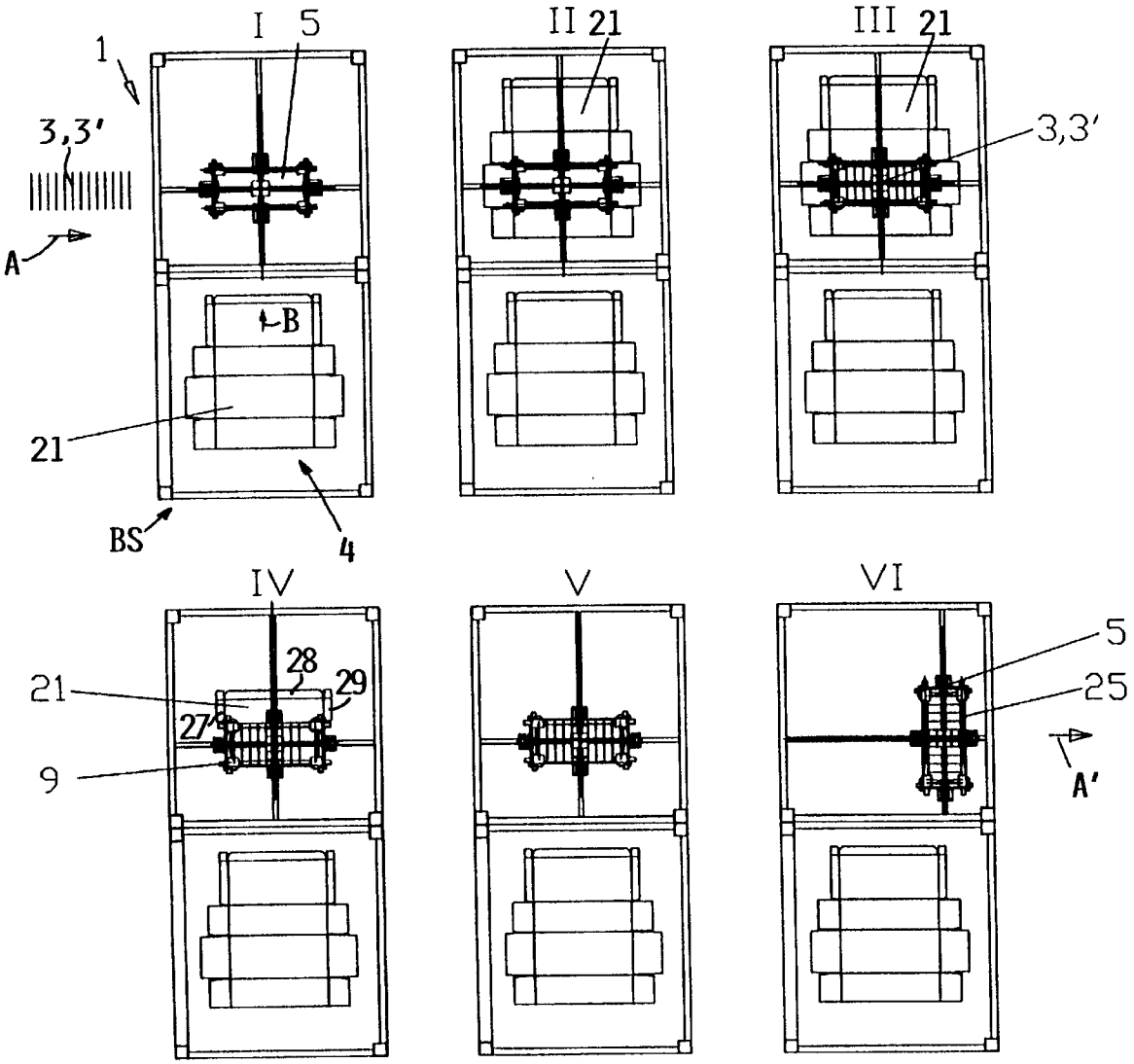
FIG. 13 shows on a reduced scale a schematic plan view onto the lower tool section and onto a stack of folding box precut blanks to illustrate a sequence of six steps for enclosing an article in a box as the box is being formed.

The rim sections 27, 28 and 29 extend along the finished folding box 25, shown symbolically in FIG. 13, in a plane orthogonally to the plane of the cover section 21, thereby reaching over the side walls of the finished box 25. More specifically, the rim sections 27 and 29 reach over the end walls while the rim section 28 reaches over the side wall 36. The end connector tabs 30 and 31 on the cover section 21 are folded inwardly. The side connector tabs 32 and 33, as well as 34 and 35 at the ends of the two side sections 24 and 36 form together with the side connector tabs 38 and 39 on the bottom section 20 and with the adhesive areas 8' the end walls of the folding box 25.

Figure 12:
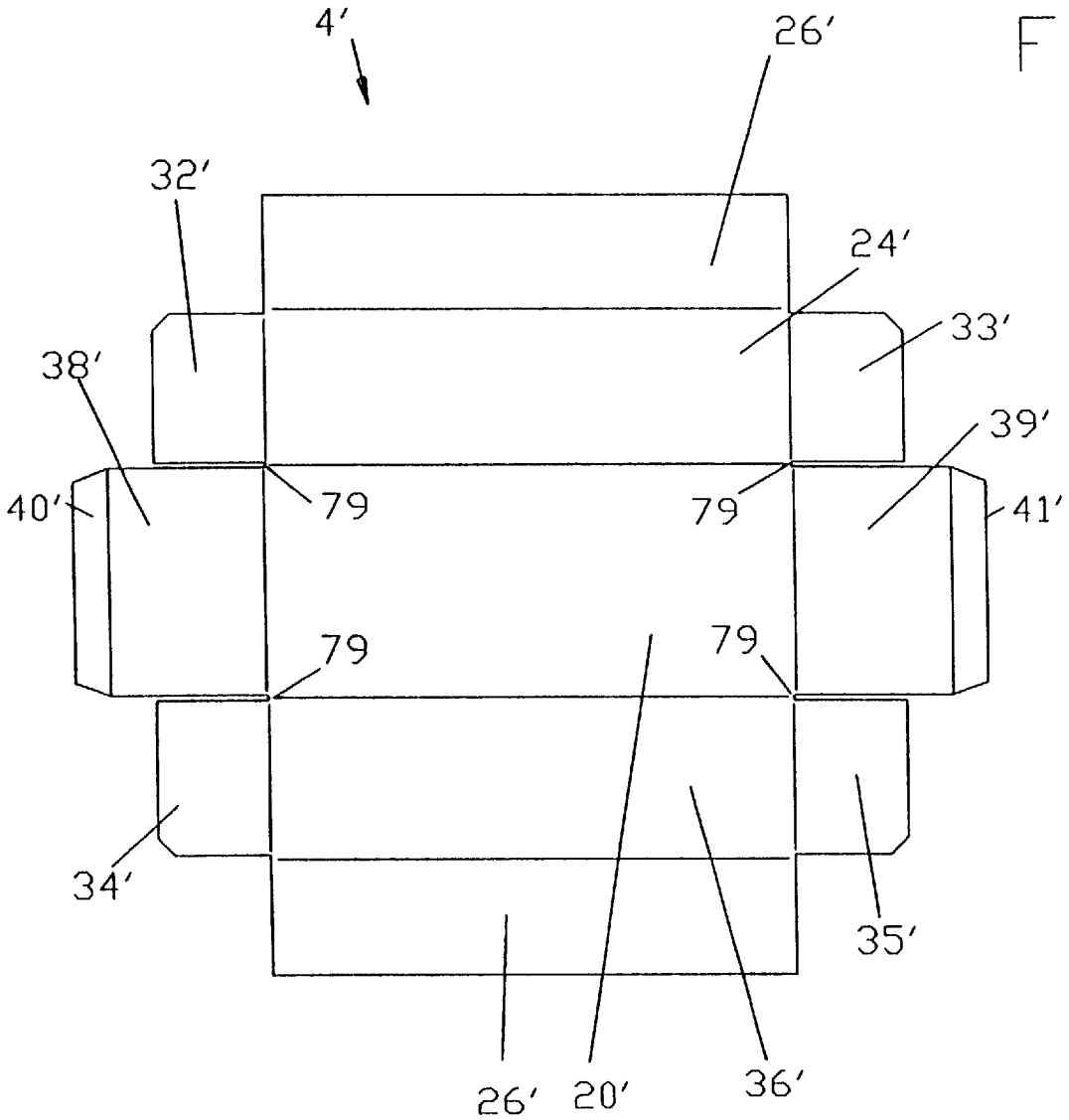
FIG. 12 is a plan view of a precut blank for forming a different folding box, wherein the cover is formed of two flap sections extending along the longitudinal box walls.

The folding box blank 4 serves for producing a flap cover box 9 with a cover that has rims 27, 28, 29 reaching over the box walls as shown in FIGS. 1 to 8 and 10. However, the folding box blank 4' shown in FIG. 12 serves for producing a single piece folding envelope box 9, without cover rims. Such a box 9' is shown in a not yet finished state in FIG. 9 just prior to closing of the two cover flaps 26'. Referring to FIGS. 9 and 12 in conjunction, the blank 4' also comprises a bottom section 20', side sections 24' and 36' and two cover flaps 26', one of which is secured to each of the two side wall sections 24' and 36'. Side connector tabs 32' and 33' are provided at the ends of the side section 24'. Connector tabs 34' and 35' are provided at the ends of the other side section 36'. Side connector tabs 38' and 39' are provided at the ends of the bottom section 20'. Each of the side connector tabs 38' and 39' carries at its free edge a respective auxiliary connector tab 40' or 41' as is seen in FIG. 12. The side sections 24' and 36' form the side walls of the not yet finished folding box 9' while the side connector tabs 32' to 35' and 38' and 39' form the end walls of the folding box.

The two blanks 4 and 4' as shown in FIGS. 11 and 12 are representative examples of any number of other folding box precut blanks for forming folding boxes of any desired size and configuration. It is an advantage of the present apparatus that it can fold boxes of any size and configuration, while simultaneously packaging at least one article while folding steps are going on.

Figure 2:
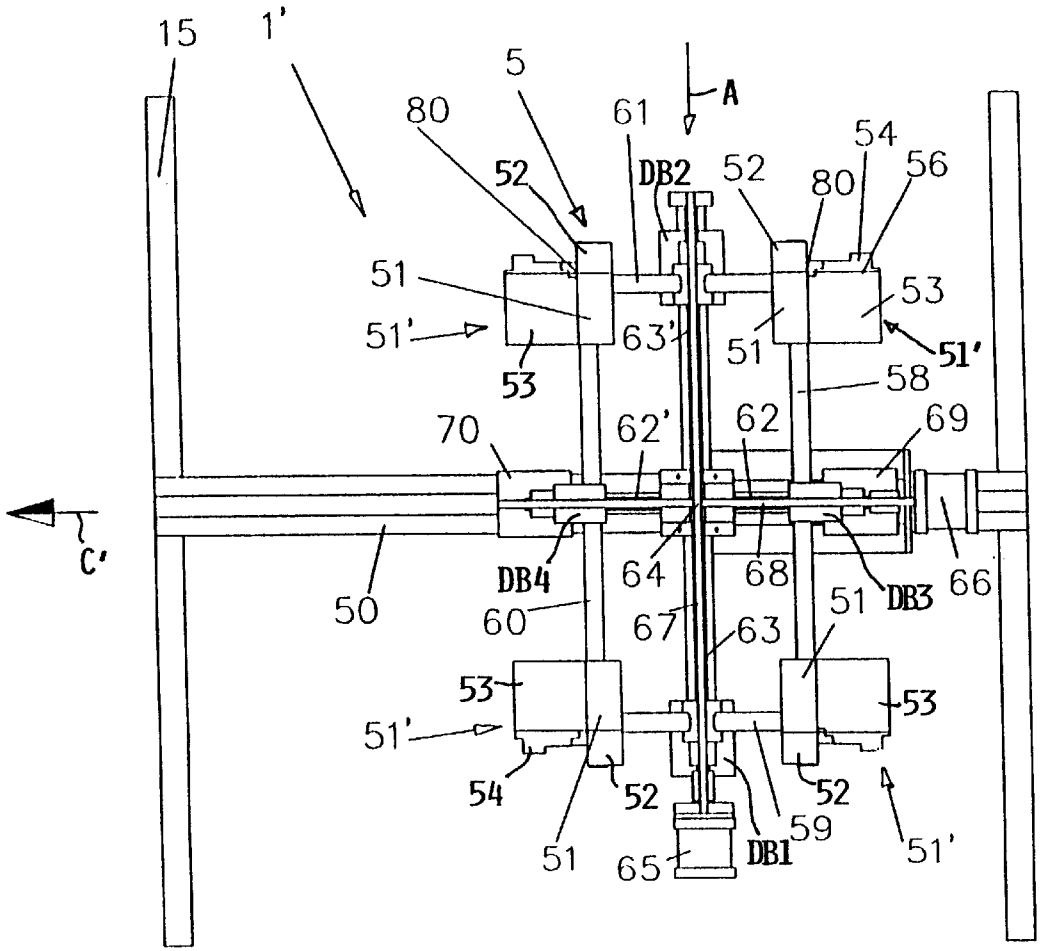
FIG. 2 illustrates schematically and on an enlarged scale a plan view of the essential components of the lower tool section according to a first embodiment of the invention.
Figure 3:
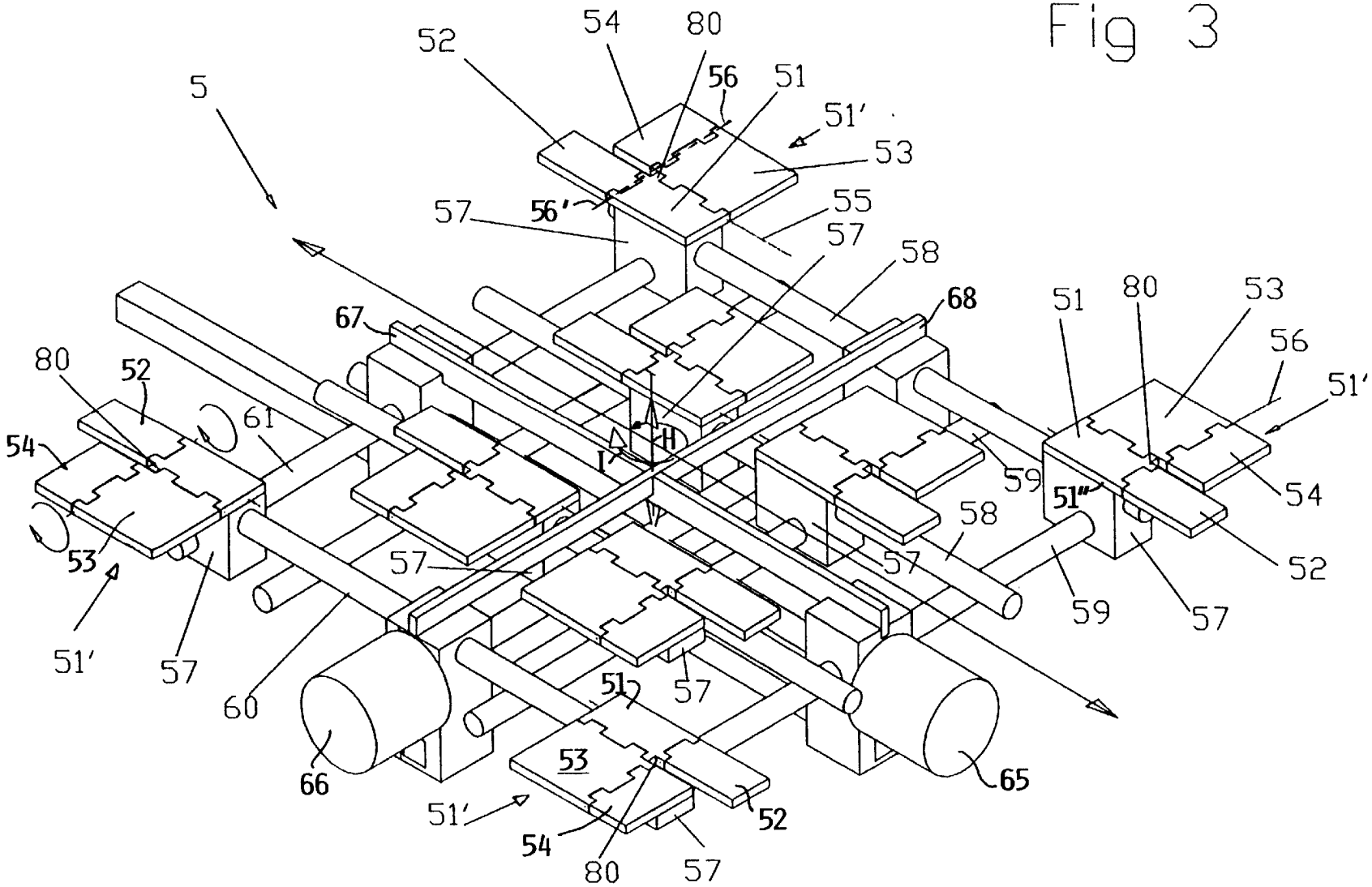
FIG. 3 illustrates on an enlarged scale a perspective schematic view of the essential components of the lower tool section in two different positions.
Figure 17:
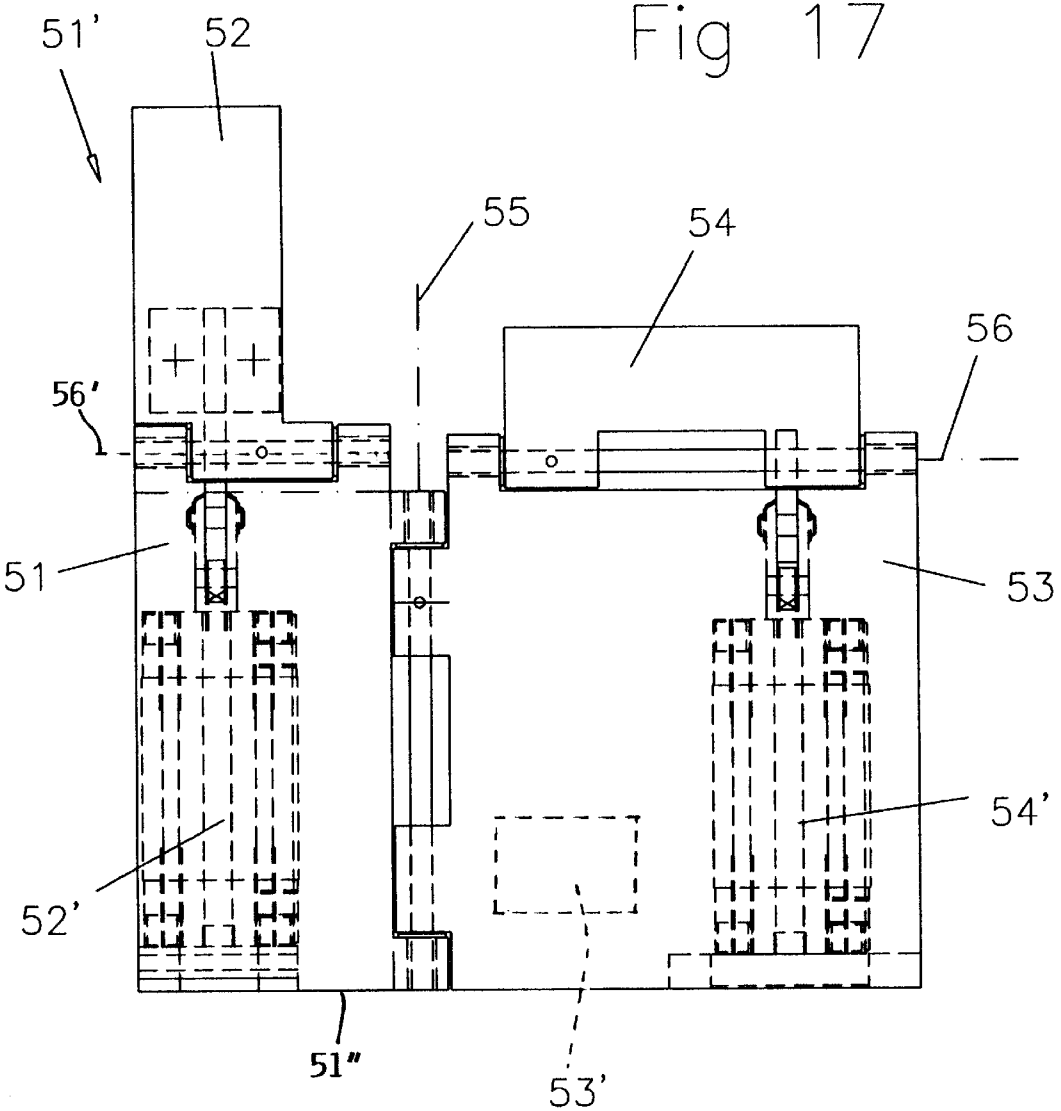
FIG. 17 shows a top plan view of the modular tool unit of FIG. 16 as viewed in the direction of the arrow XVII in FIG. 16.

According to a first embodiment of the invention an apparatus 1' shown in FIG. 2 comprises in its simplest form a table for folding blanks. This table or work support surface 51 is formed by a lower tool section 5, as shown in the plan view of FIG. 2. The lower tool section 5 is movable in the machine frame 15 on a rigidly mounted guide bed 50 for horizontal back and forth movement. An article 3, 3' to be packaged is supplied onto the work support surface of the lower tool section in the direction of the arrow A and removed upon completion of the folding, packaging and gluing in the direction of the arrow C', whereby the lower tool section 5 is then returned from a left-hand position not shown in FIG. 2 back into a right-hand position shown in FIG. 2. simplified illustration of FIG. 2 shows the blank or work support surface 51 formed by the lower tool section 5 comprising four corner modular tool units 51'. Each tool unit 51' comprises a substantially rectangular surface forming support element 51". Four of these elements positioned at the same level form the work or blank support surface 51. Additionally, each corner modular tool unit 51' comprises four tool elements in the form of folding flaps 52, 53 and 54. The folding flap 52 is tiltably mounted along an outer narrow side or edge of the support element 51". Viewing FIGS. 2 and 3 together, the two folding flaps 53 and 54 are journalled to a longitudinal edge of the support element 51" for tilting about an axis 55. Further, the folding flap 54 is journalled to the flap 53 for tilting about an axis 56. The folding element 52 is hinged to the support element 51" for tilting about an axis 56' as best seen in FIGS. 3 and 17. The journal axes 56 and 56' extend in parallel to each other and slightly displaces relative to each other by a spacing corresponding to a thickness of the cardboard of which the blanks are cut. All elements 51, 52, 53 and 54 are in a horizontally oriented starting position, whereby the surfaces of these elements are flush with the blank support surface 51 defined by the four support elements 51" forming part of the corner modular tool units 51' and by the upwardly facing edges of the support bars 67 and 68. However, in FIG. 2 the folding flaps 54 are already tilted upwardly and thus project above the surface 51 defined by the support elements 51" and by the upper edges of the support rails 67 and 68.

Referring further to FIG. 3, each modular corner unit 51' comprises a guide block 57 carrying an upwardly facing flat support element surface 51" that provides the work support surface 51 together with the flat upper edges of the support bars 67, 68. The folding flaps 52, 53 and 54 are journalled to the support element 51" along axes 55, 56 and 56', and thus are foldably secured to the guide block 57. The guide blocks 57 in turn are movably supported on guide rails 58, 59, 60 and 61 forming a rectangle for the guide blocks 57. FIG. 3 shows the four corner modular tool units 51' in two different positions, namely a fully extended outer position and a drawn in central position. A substantially larger blank 4 can be folded when all four corner units 51' are in the outer position. Smaller blanks are handled when the corner units are in the central position. For displacing the guide blocks 57 with their respective corner units, these guide blocks are driven in synchronism toward each other or away from each other.

Figure 16:
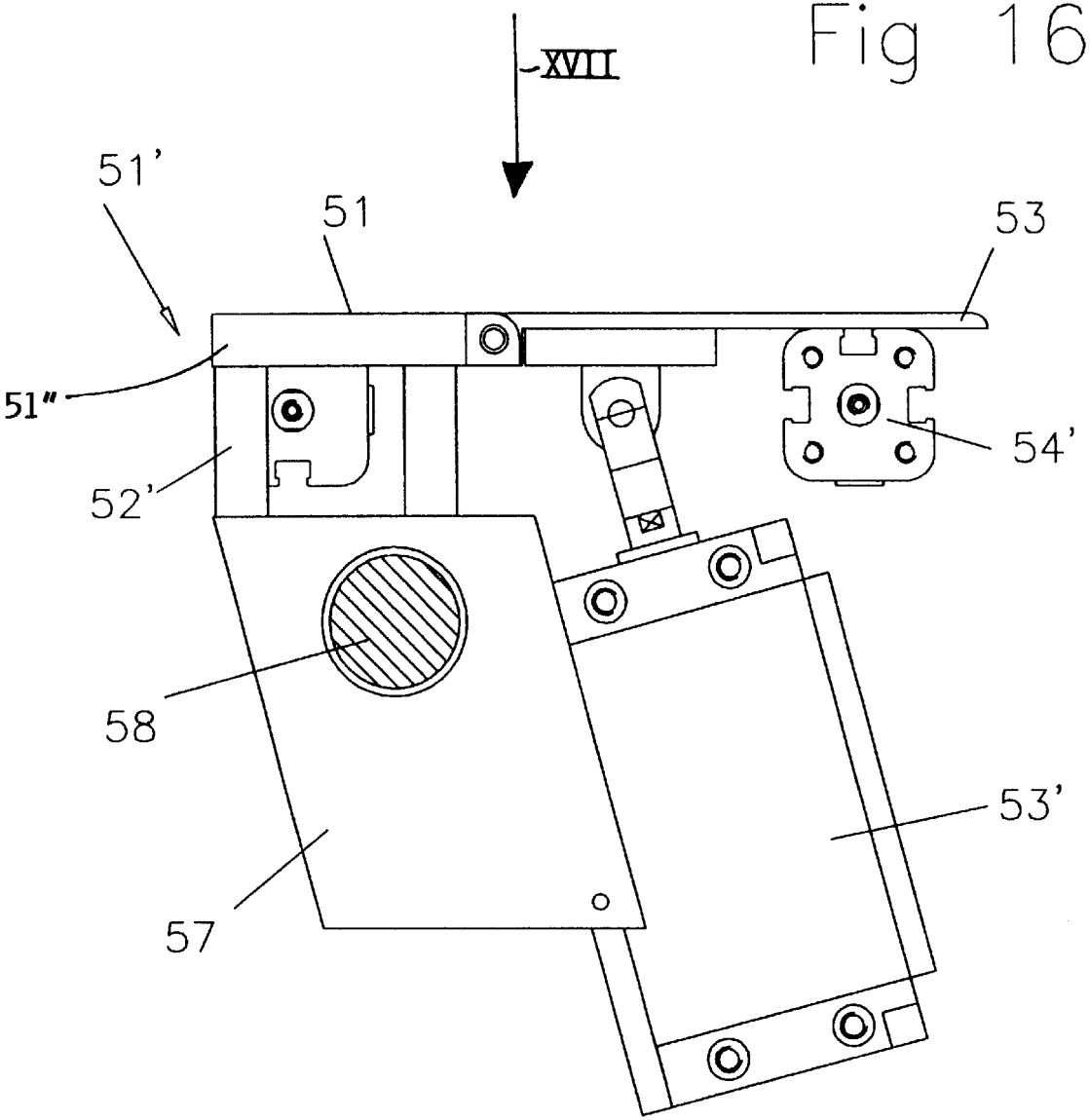
FIG. 16 shows on an enlarged scale relative to FIG. 1 and partially in section a side view of a corner tool modular unit illustrating the drives for the several flaps of each modular tool unit.

Referring to FIGS. 16 and 17, each corner tool unit 51' has individual drives 52', 53' and 54' for the respective folding flaps 52, 53 and 54. FIG. 17 shows more clearly that the journal axis 56 of the folding flap 54 extends in parallel with the journal axis 56' of the folding flap 52 as explained above. FIGS. 16 and 17 also show more clearly how the work support surface 51 is provided by the individual support element 51" which is mounted to its support and guide block 57 which in turn is slidably mounted on its guide rail 58. In the rest position of the lower tool section 1 as shown in FIGS. 1, 3, 16 and 17 all flaps 52, 53 and 54 are in a horizontal position flush with the surface 51 of the support element 51" in each corner unit 51'. These corner units 51' are in turn so positioned that the corners 80 of the support elements 51" will coincide with the four corners 79 of the bottom section 20 of any blank.

FIG. 2 shows further drive elements 62, 62' and 63, 63' for moving the guide blocks 57 and thus the respective corner modular tool units 51' toward each other or away from each other. These drive elements may, for example, include transmission spindles 62, 62'; 63, 63' driven by motors 65 and 66 shown in FIGS. 2 and 3. The spindles 62, 62'; 63, 63' are mounted below the work support surface 51 and cross each other in the center 64 of the lower tool section 5.

The drive spindles 62, 62' have, for example, opposing threadings so that their rotation brings the guide rods 58 and 60 toward each other or away from each other depending on the direction of rotation of the motor drive shaft. Similarly, the spindle sections 63 and 63' have opposing threadings so that the guide rods 59 and 61 can be moved toward each other or away from each other. The spindles are arranged between the guide rods forming two pairs. As seen in FIG. 2, the spindle 63 is coupled to the guide bar 59 through a drive box DB1. The spindle 63' is coupled to the guide rod 61 through a drive box DB2. The spindle 62 is coupled to the guide rod 58 through a drive box DB3. The spindle 62' is coupled to the guide rod 60 through a drive box DB4.

As mentioned above and referring to FIGS. 1, 2 and 4, the support rods 67 and 68 which cross each other in the center 64 of the lower tool section 5 and can, for example, be mounted on the drive boxes DB1 to DB4. The upper edge surfaces of these rods 67 and 68 are flush with the support surface 51 formed by the support elements 51". These rods 67 and 68 are positioned above the spindles approximately in vertical alignment with the spindles. These support rods 67 and 68 make sure that the blank 4 cannot bend downwardly in its center, especially when an article 3, 3' is placed on the blank 4 resting on the surface 51 in the lower tool section 5.

Figure 4:
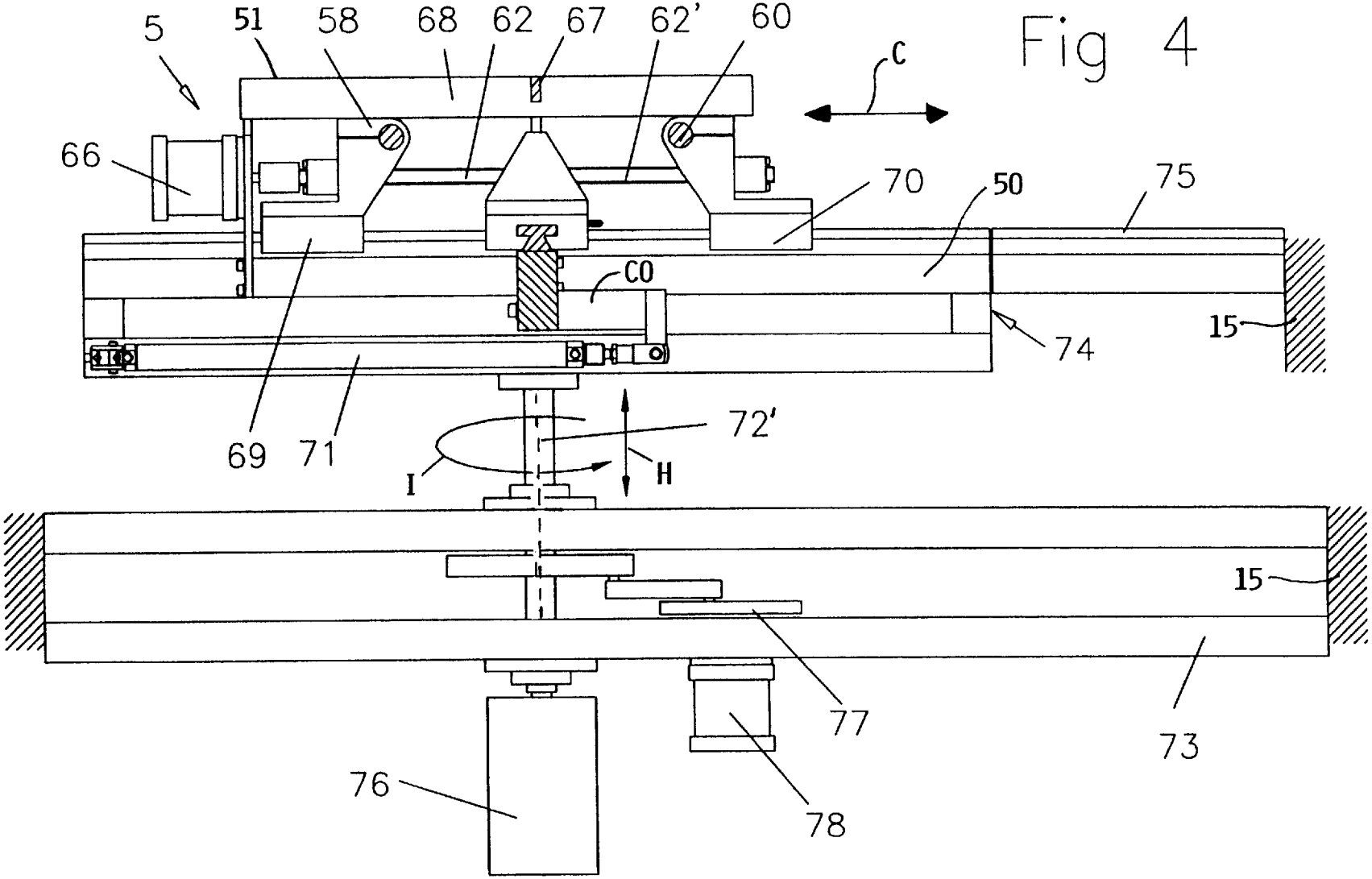
FIG. 4 is a partial sectional schematic side view of essential lower tool section components according to a second embodiment of the invention.

Referring further to FIG. 2, the entire lower tool section 5 is movable horizontally back and forth on a guide bed 50. For this purpose slides 69 and 70 ride in unison on the guide bed 50. A separate drive 71, such as a piston cylinder device shown in FIG. 4, is provided for shifting the four modular corner units 51' and thus substantially the entire lower tool section 5 to the left or to the right in unison. The piston cylinder drive 71 moves the lower tool section 5 in FIGS. 1 and 2, first to the left and then back to the right. In FIG. 4 the lower tool section is in its left-hand position and when the piston rod of the piston cylinder drive 71 is extended, the lower tool section 5 will move to the right.

While the lower tool section 5 according to FIG. 2 can be moved, as mentioned, out of the right-hand position into a left-hand position and back again along the guide bed 50, the lower tool section 5 of the second embodiment shown in FIG. 4 is movable back and forth horizontally as indicated by the arrow C and up and down as indicated by the arrow H. FIG. 4 shows a power source 76 for this lifting and lowering of the lower tool section 5 which is mounted on a drive shaft 72 that can be raised and lowered. The shaft 72 can also be driven for rotation about the central vertical axis 72' by a drive motor 78 and a power transmission 77 as indicated by the arrow I. The entire lower tool is mounted on a cross beam 73 which in turn is secured in the machine frame 15.

As shown in FIG. 4, the lower tool section 5 of the second embodiment is mounted on its slides 69 and 70 that ride on the guide bed 50. However, the guide bed 50 is supported by a carrier 74 operatively mounted to the vertical shaft 72 for vertical lifting or lowering and for rotation or tilting about the central axis 72'. The horizontal motion is accomplished, for example by the above mentioned piston cylinder device 71 connected at one cylinder end to the carrier 74 and with the other piston rod end through a coupling CO to the lower tool section 5, whereby the latter is movable as indicated by the arrow C. When the bed 50 is axially aligned with an intermediate guide rail section 75 secured to the machine frame 15 the lower tool section 5 can be moved at least partially onto the guide rail section 75.

The above mentioned drive motor 76 could, for example, drive a spindle inside the shaft 72 or the latter could be a spindle for lifting and lowering the lower tool section 5 as indicated by the arrow H. As shown, the lower tool section 5 is in its uppermost position. Both, the lifting drive 76 and the turning or tilting drive 77 with its own motor 78 are mounted to the fixed carrier cross beam 73 in the frame 15.

It is to be noted that the horizontal drive 71, the lifting or vertical drive mechanism 76 and the rotating drive mechanism 77, 78 do not have to be provided simultaneously or together in the same embodiment. Such an embodiment, however, may be advantageous for certain purposes while other purposes can be satisfied either only with the horizontal drive or with the vertical drive or only with the rotating drive. The combined or individual use of these drives for the lower tool section 5 will depend on the types of blanks to be folded and on the supply direction of blanks and on the discharge direction of filled, folded and closed boxes.

In operation the folding box blank 4 or 4' is positioned onto the support surface 51 formed as described above by the support elements 51" in each corner modular unit 51', whereby the corner points 79 of the bottom sections 20 or 20' of the respective blank are aligned with the corners 80 of the support elements 51".

Suction devices not shown but provided in the support elements 51" hold the blanks 4 or 4' in a proper position, whereupon an article 3, 3' is placed on the blank by conventional mechanisms not shown.

First, the drives 53' are activated to tilt the flaps 53 upwardly for moving the side wall sections 24 and 36 out of their horizontal position into a vertical position, whereby the precreases between the bottom section 20 and the side wall sections 24 and 36 become effective. Simultaneously with the folding of the side wall sections 24 and 36 into a vertical position, the end wall sections or blank flaps 32 to 35 are also folded into a vertical position together with the respective side wall section 24 and 36 by the flaps 53. Next, the folding flaps 54 are operated by their respective drives 54', whereby the end wall flaps 32 to 35 are folded toward each other to partly form the end walls of the box, whereby the article 3, 3' is already enclosed on five sides.

Next, the lower tool section 5 is moved to the left for the application of adhesive by the nozzles 7' to the outwardly facing surfaces 8' of the already folded end wall sections or blank flaps 32, 33, 34 and 35, see FIG. 10.

If a stack 3 is being packaged, as distinguished from a single article, it is suitable that any stack holding elements, for example, so-called "swords" are lifted and removed laterally prior to the passage of the lower tool section 5 past the adhesive dispensing nozzles 7'. Such stack holding swords are part of the transport mechanism that brings the stacks to the folding machine and sets an article down on bottom section 20.

As soon as the end wall blank flaps 32 to 35 have been provided with glue, the further end wall sections 38 and 39 connected by respective precreased lines to the bottom section 20 are folded upwardly by energizing the drive 52' to tilt the flaps 52 upwardly, thereby pressing the end wall section 38 against the end wall sections 32 and 34 and the end wall sections 39 against the end wall sections 33 and 35. The folding flaps 52 are held in this position to press the end walls sections 38 and 39 against the respective end wall sections 32, 34 and 33, 35 until the glue has sufficiently set to hold the box together. As a result of the just described sequence of first folding the end wall sections 32, 34; 33, 35 toward each other and then folding the end wall sections 38, 39 the latter sections form outer end walls as shown in FIG. 10. However, when the folding sequence is reversed, namely first folding the sections 38 and 39 and then sections 32 to 35 these shorter sections 32 to 35 will be positioned outside the sections 38, 39.

Referring to FIG. 5, the two adhesive applicators 7 are mounted for horizontal back and forth displacement on a guide rod 81. Each adhesive applicator 7 comprises a lifting mechanism and positioning mechanism 82 each provided with its own servomotor 83 for the nozzles 7' where needed. Each lifting mechanism carries at its free end an adhesive applicator 84 comprising at least one glue dispensing nozzle 7'. These nozzles 7' face the end wall sections of the partially finished box 9. Hoses 85, preferably flexible hoses, are connected to the applicator 84 for supplying adhesive to the applicators from a source not shown. The applicator system with its positioning mechanism 82 is mounted on the machine frame extension 15' as seen in FIG. 5.

After glue has been applied as described above, the positioning mechanism 82 for the adhesive applicators 7, 7' shown in FIG. 5 makes it possible to bring the applicator nozzles 7' into an advantageous position for subsequently applying adhesive to the corner connector tabs 30 and 31 of the cover section 21 when the incomplete box 9 is moved into an end position to the left under the upper tool section 6.

Figure 6:
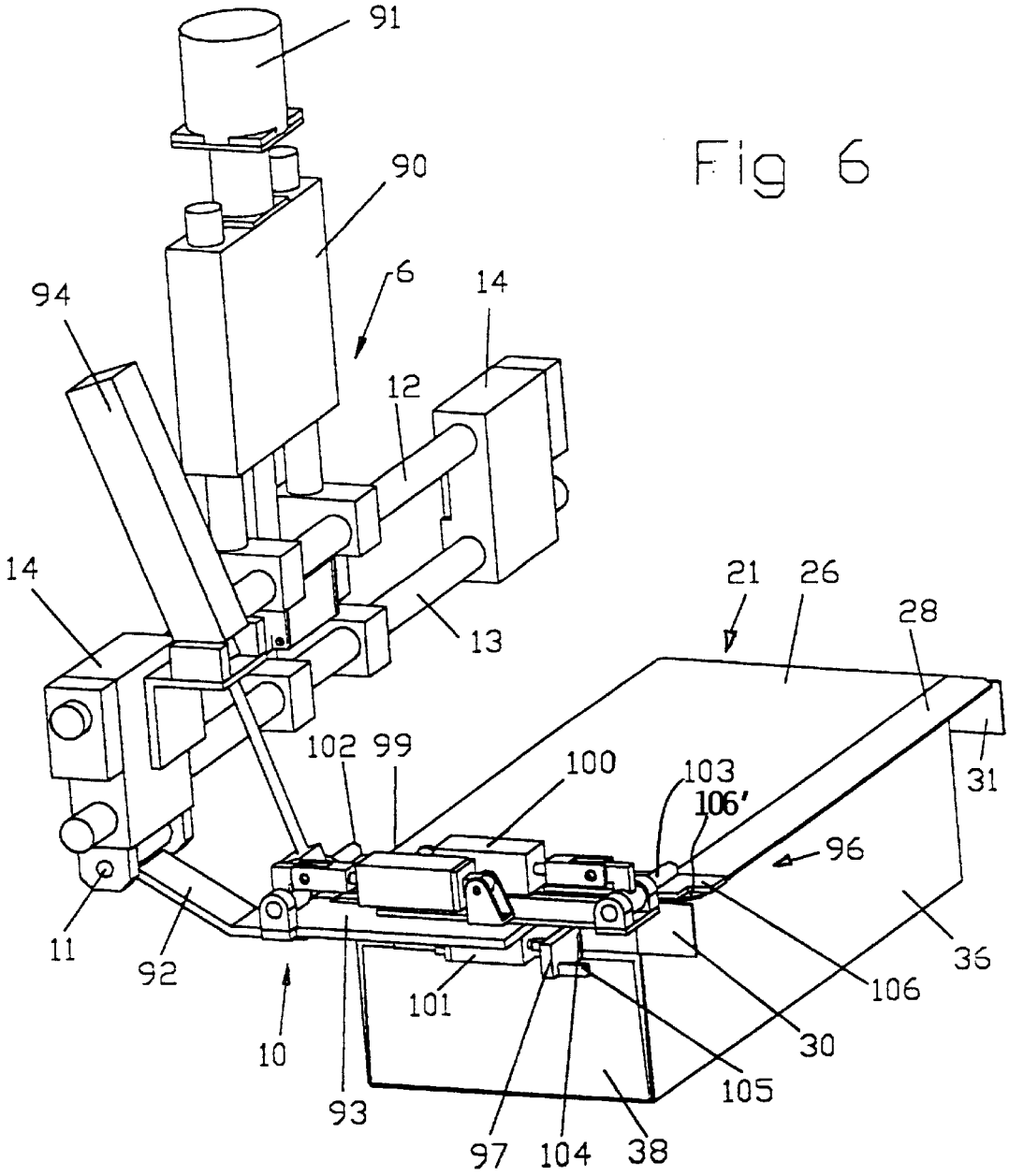
FIG. 6 shows a perspective view of essential components of a guide for the upper folding tool section, whereby only one half of the upper folding tool section is shown to simplify the illustration.
Figure 7:
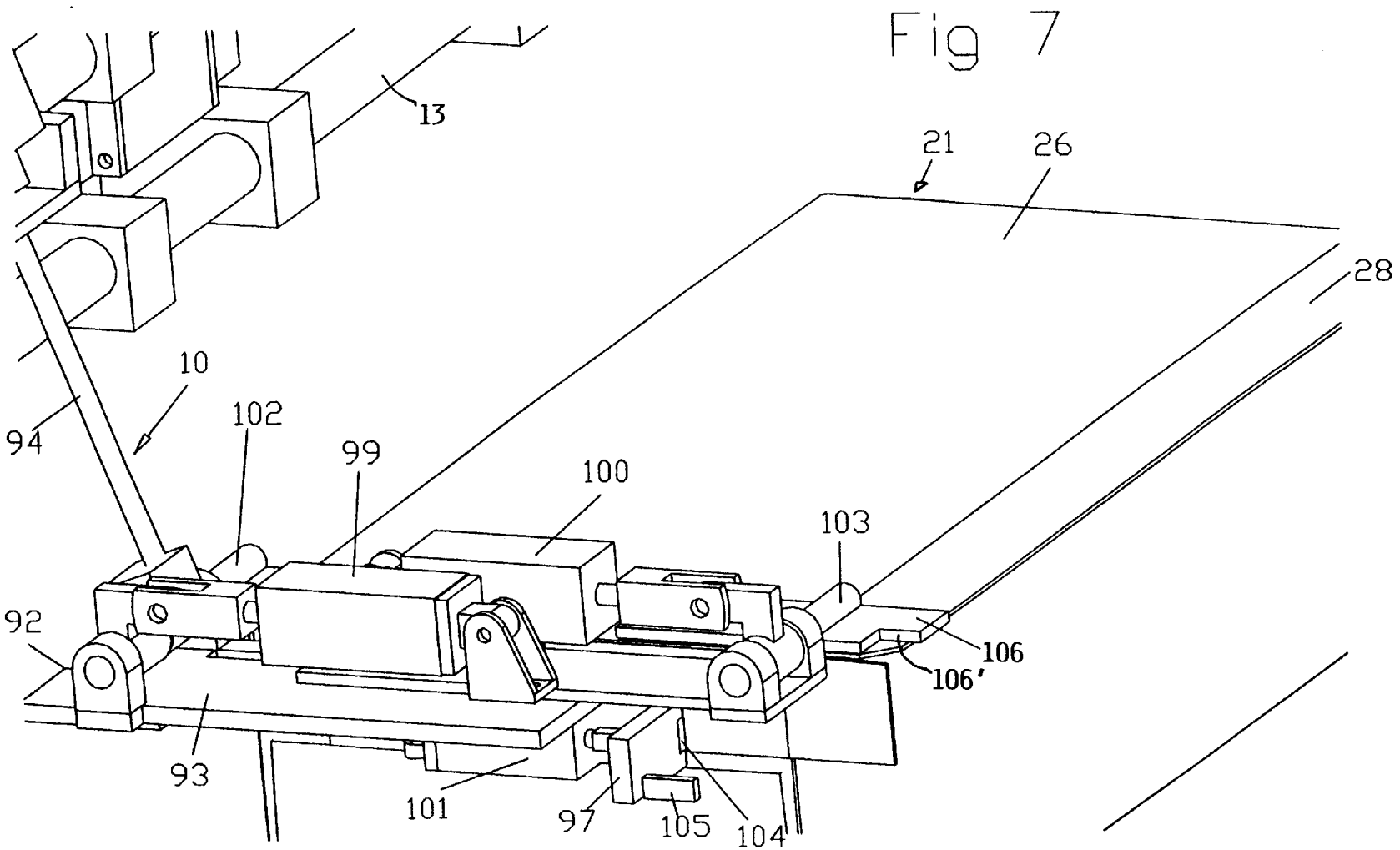
FIG. 7 shows one half of the upper folding tool section of FIG. 6 on an enlarged scale.
Figure 8:
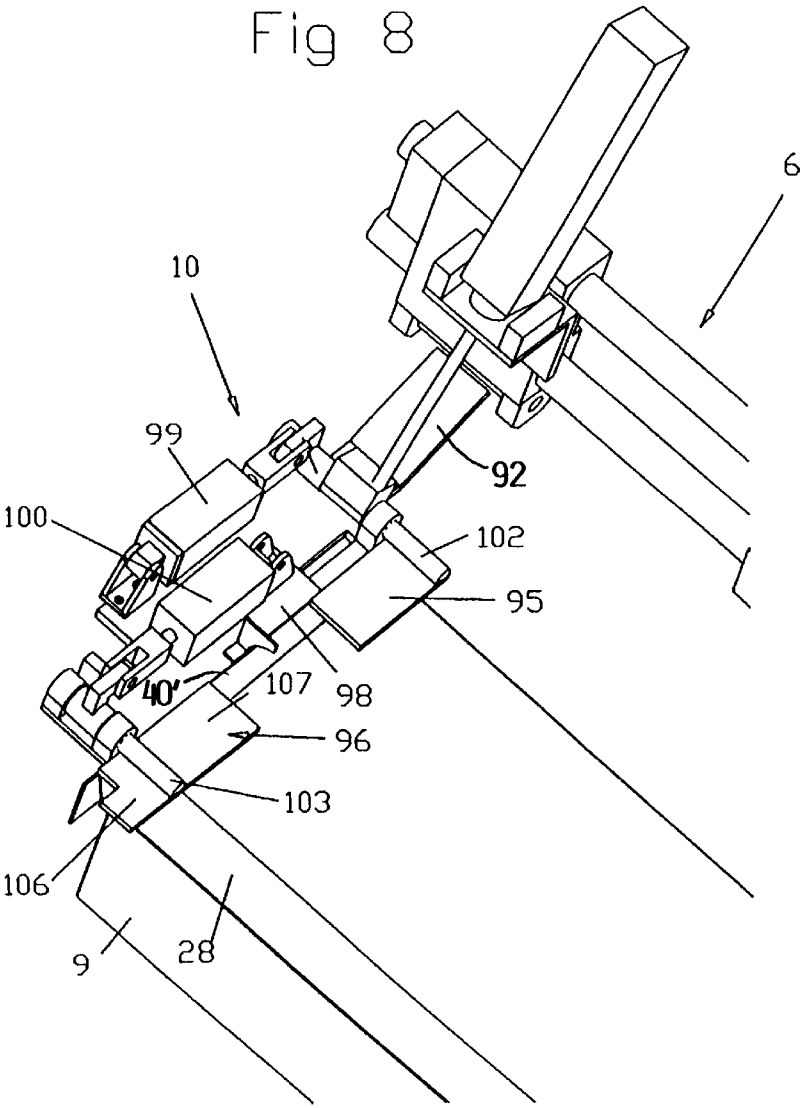
FIG. 8 is a perspective view from another direction of components also shown in FIGS. 6 and 7.
Figure 9:
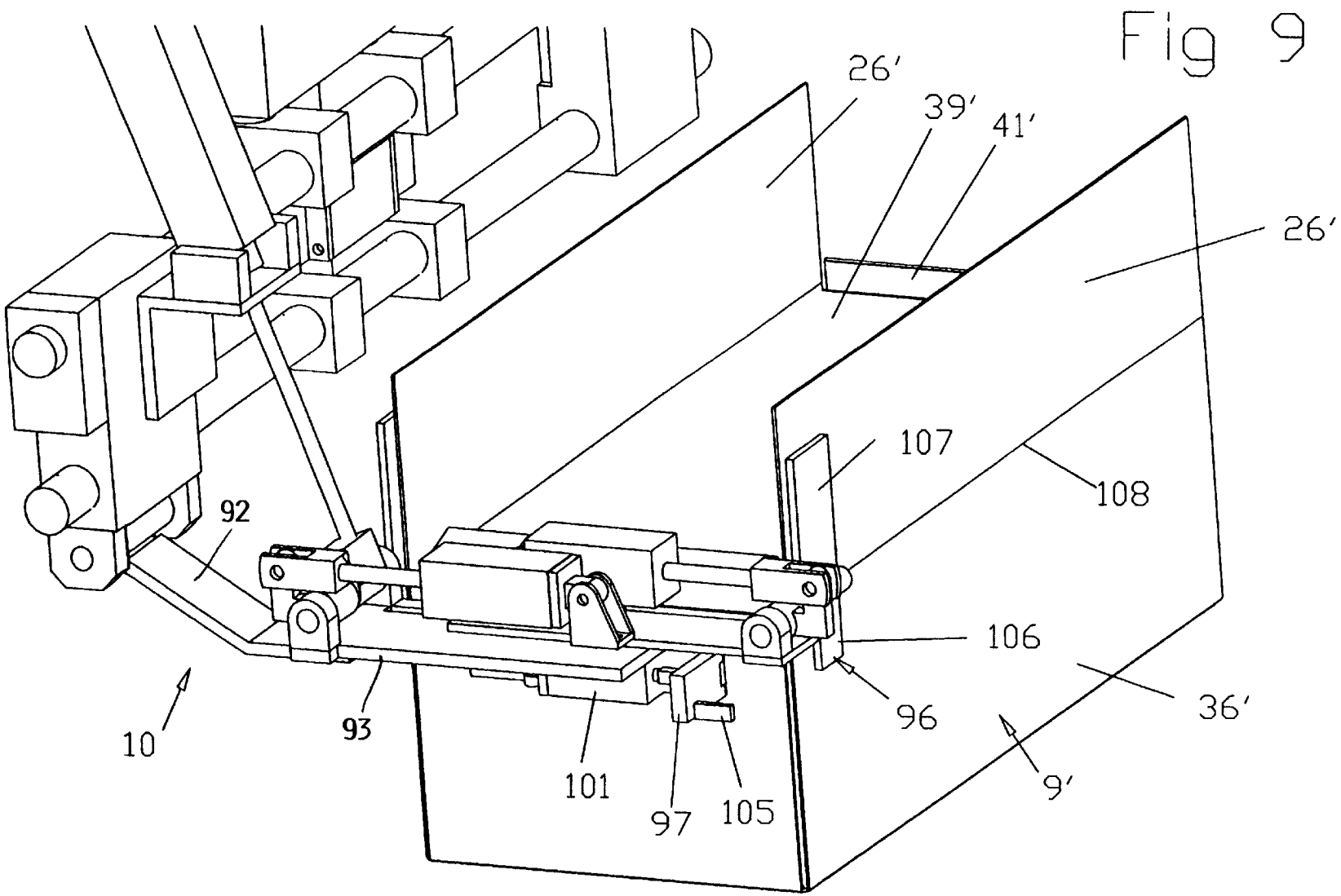
FIG. 9 is a perspective enlarged view similar to that of FIG. 6, however, illustrating the formation of a different box configuration.

Referring to FIGS. 6, 7 and 8, the edge or rim sections 27, 28 and 29 of the cover 21 including the corner connector tabs 30, 31 are folded out of the upright position into a horizontal position by the operation of the upper tool section 6. For this purpose the two half sections 10 of the upper tool section 6 press the cover 21 onto the still not completely finished box 9 as folded by the lower tool section 5. Simultaneously, the edge or rim sections 27 and 29 with their respective connector tabs 30 and 31 are brought into a vertical position or rather into a position orthogonally to the plane defined by the cover section 26 of the cover 21. This is accomplished by applying the upper tool section 6 to the edge or rim sections 27 and 29 until these rims assume the proper position relative to the section 26 of the cover 21.

Referring to FIGS. 6 to 8, both half sections 10 of the upper tool section 6 are adjustable in their elevational position by a guide mechanism 90 including a respective drive 91 mounted in the machine frame extension 15' seen in FIG. 1. A carrier arm 92 is journalled to each of the support or mounting blocks 14 for tilting about the axis 11 as shown in FIG. 6. Only one of the two upper tool half sections is shown in FIGS. 6 to 9. The other half section 10 is constructed mirror-symmetrically to the one shown. Each carrier arm 92 has a somewhat angled arm extension 93 extending horizontally when the arm 92 assumes a lowered position, whereby the arm 93 extends parallel to the work support surface 51. A piston cylinder device 94 serves for lowering or raising the carrier arm 92 in the positions shown in FIGS. 1 and 6.

Each carrier arm 92 supports with its extension 93 three folding flaps 95, 96, 97 and a cover guide 98. Each of the flaps 95, 96 and 97 is individually driven by a respective drive 99, 100 and 101. The folding flap 95, 96 and 97 are tiltable about axes 102, 103 and 104 respectively. These axes are suitably supported on the arm extension 93. The drives 99, 100 and 101 are operable in a coordinated manner with one another for achieving the desired folding sequence. These drives 99, 100 and 101 are, for example, pneumatic drives. Pressurized fluid supply lines and so forth are not shown in the FIGS. to simplify the illustration. Incidentally, the drives 52', 53' and 54' for the respective flaps 52, 53 and 54 of the lower tool section 5 may also be pneumatic drives.

When the upper tool section 6 presses the cover 21 downwardly, the folding flaps 95 and 96 move the cover 21 until it contacts the upper edges of the still unfinished box 9. Simultaneously, the extension arms 93 at each half section 10 of the upper tool section 6 press and fold the rim sections 27 and 29 including the corner tabs 30 and 31 into the positions shown in FIGS. 6, 7 and 8. The arm extensions 93 are moved downwardly until the nozzles 7' are positioned laterally next to the side wall sections 38 and 39. On the downward movement the edges of the arm extensions 93 facing the box press the respective rim sections 27 or 29 downwardly so that these rim sections are folded downwardly to contact the upper edges of the end wall sections 38 and 39 which are connected to the bottom section 20.

The folding of the corner connector tabs 30 and 31 shown in FIG. 6 is accomplished, for example, with the aid of fingers 105 each journalled to the folding flap 97 about the axis 104 and movable by its own drive 101. As soon as the corner connector tabs 30 and 31 contact the side wall 36 as shown in FIG. 6, the folding flaps 96 press the longitudinal rim section 28 into the box closing position.

FIGS. 6, 7 and 8 show that each folding element 106 of the folding flap 96 comprises a corner cutout 106' through which the finger 105 can reach for holding the respective end tab 30, 31 in the proper box closing position. Adhesive has been applied to the end tabs 30 and 31 prior to their being folded over into the box cover finishing position in which the longitudinal rim section 28 is adhesively bonded to the tabs 30 and 31.

After all rim or sections 27, 28, 29 of the cover 21 have been folded over, the folding box 25 is complete and it is removed from the support surface 51, for example in the direction from right to left in FIG. 1 to move out below the upper tool section 6.

FIG. 12 shows a folding box blank 4' with two cover flaps 26'. A box made of such a blank 4 can be filled, folded and finished in the same apparatus 1 as described above by performing basically the same operational folding steps, even though the blank of FIG. 12 has two cover flaps 26' instead of a single cover 21. As shown in FIG. 9 the folding of the blank 4' does not require the operation of the folding flap 97 with the finger 105. Therefore, these elements are shown in a withdrawn position in FIG. 9. Thus, the drive 101 for the finger 105 is in an idle position. The function and operation of the other elements, however, remains the same as described above. However, the folding flap 96 comprises two folding elements 106 and 107. The folding flap 96 extends over the precrease folding line 108 between the side wall 36' and the respective cover flap 26' as shown in FIG. 9, whereby the folding element 106 holds the longitudinal side wall 36' in its upright position while the folding element 107 folds the respective cover flap 26' into the closed position. A folding of a rim section 28 as shown in FIG. 7 is not necessary in FIG. 9. Therefore, a retooling of the apparatus 1 for folding different blanks is not necessary.

FIG. 8 shows a cover guide 98 for folding over the auxiliary flaps 40' and 41' extending alongside the upper edges of the end walls 38' and 39' respectively. Two such cover guides 98 are provided, one at each end of the box 9'. These guides are secured to the carrier arm extensions 93 of the carrier arms 92. The cover guides 98 are necessary only for blanks shown in FIG. 12 and are not necessary for blanks without the auxiliary flaps 40', 41'.

The folding flaps and their drives forming the upper tool section 6 are suitably mounted in a position adjustable manner to the carrier arm 92 or its extension 93, whereby it becomes possible to fold blanks of different sizes.

Figure 14:
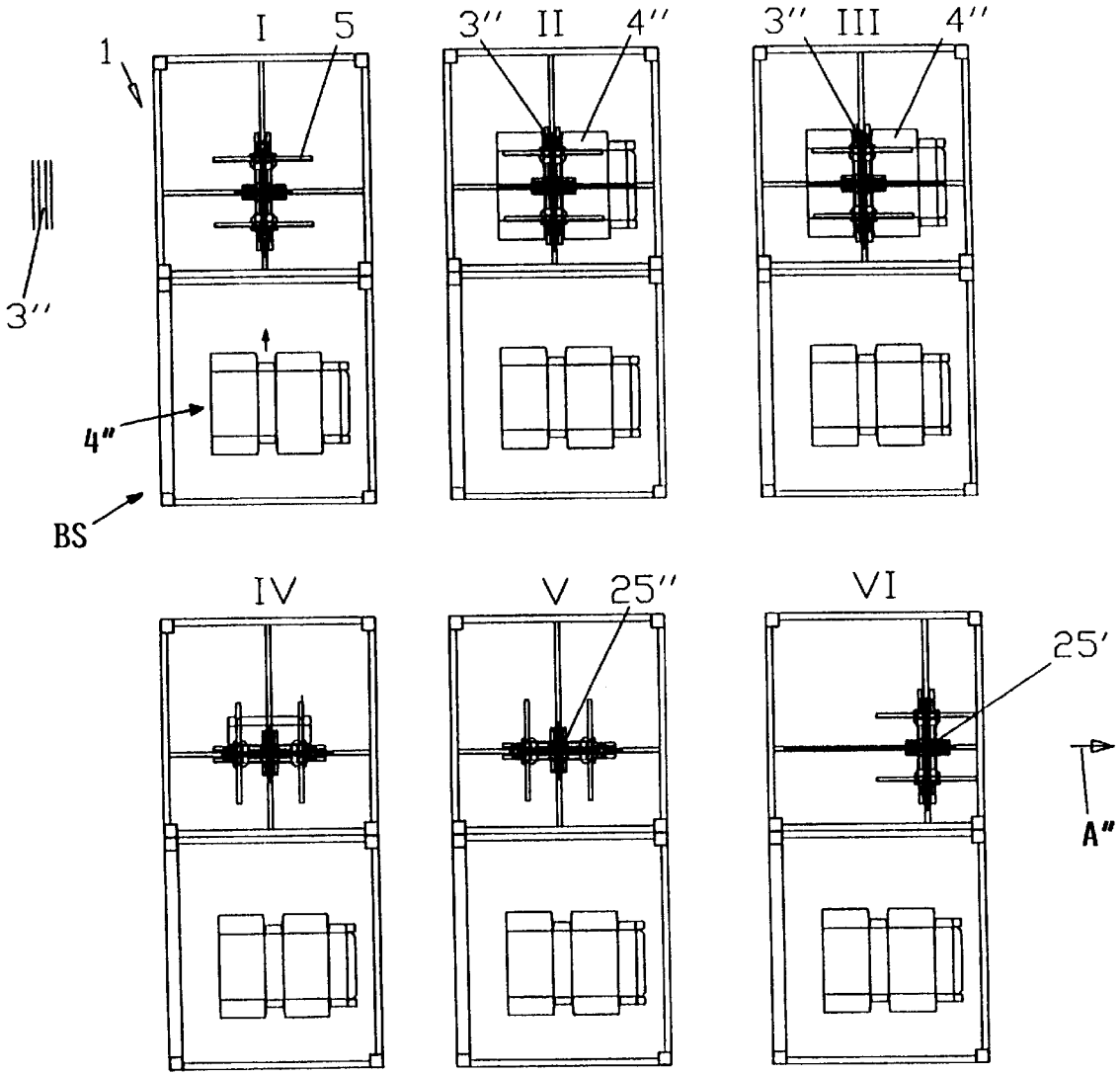
FIG. 14 is a plan view similar to that of FIG. 13, but illustrating the packaging of another article.
Figure 15:
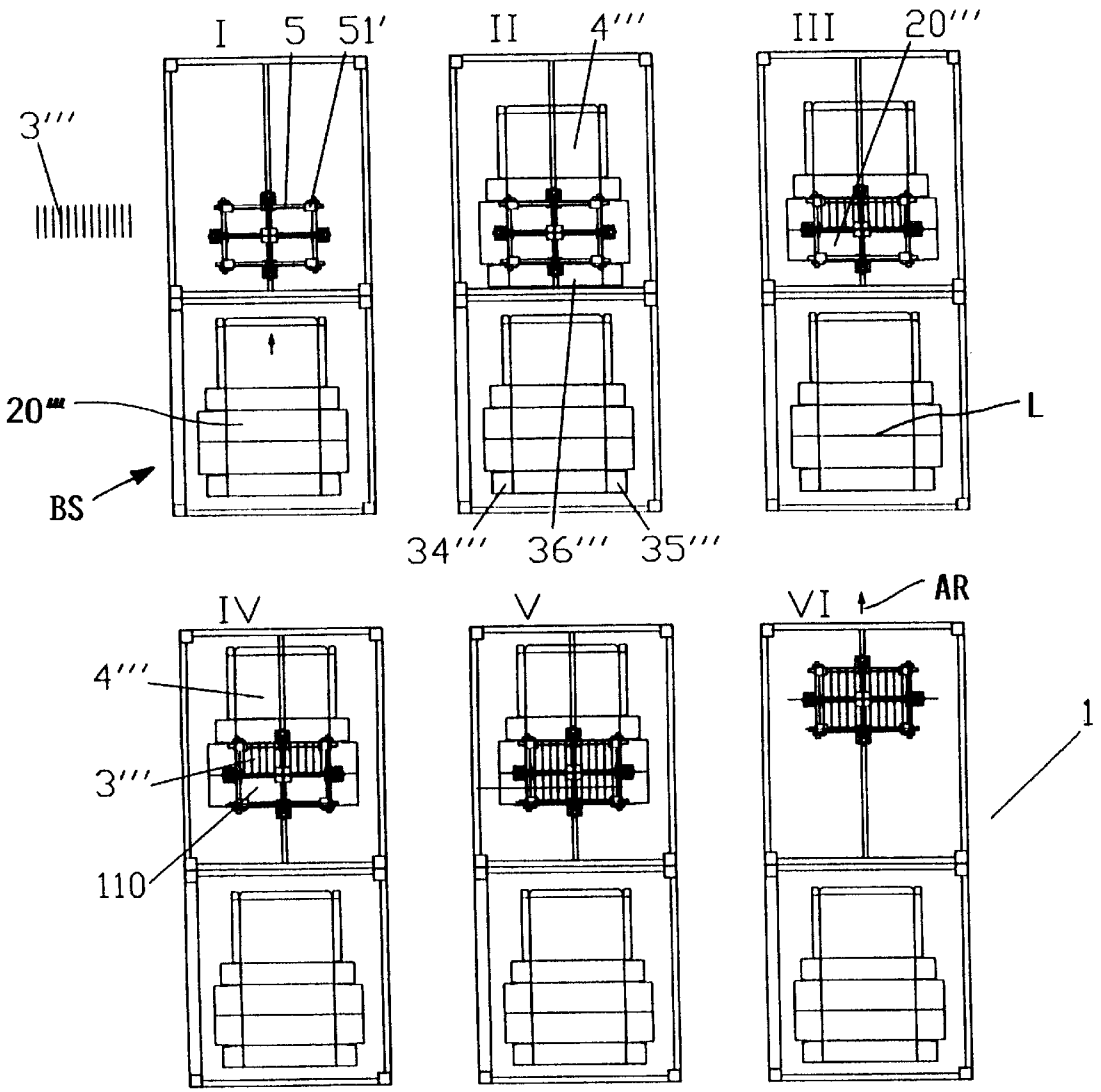
FIG. 15 is a view similar to that of FIGS. 13 and 14 illustrating the packaging of two articles in one box.

FIGS. 13, 14 and 15 show schematically a sequence of steps for folding and packaging different articles in partly different precut blanks.

FIG. 13 shows in six steps I to VI the sequence of a folding and packaging operation. In step I a stack 3 or article 3' is supplied in the direction of the arrow A toward the folding and packaging machine 1. A supply of blanks 4 is held in a magazine BS. In step I the blank 4 has not yet reached the support surface 51, but the lower tool section 5 is in a position to first receive a blank. According to step II a blank 4 has been positioned on the surface 51 formed in the lower tool section 5 as described above. In step III, an article 3, 3' has been placed onto the bottom section 20 of the blank 4 with the above mentioned alignment of corners 79 and 80. In step IV the folding of the box 9 is substantially completed, except for the folding and closing of the cover 21. In step V the cover has been folded and closed by the upper tool section 6. In step VI the lower tool section 5 has been rotated by 90° as described above with reference to FIG. 4 by the drive 77, 78. The finished package 25 can now be discharged or removed in the direction of the arrow A'.

FIG. 14 shows a sequence of six steps I to VI for the folding of a different blank into a box suitable for an article 3" having distinctly different dimensions compared to the article packaged in FIG. 13. The blank 4" is oriented differently in the blank supply magazine BS as seen in FIG. 14. In step I of FIG. 14 the lower tool section 5 or rather its modular corner tool units 51' are adjusted into positions suitable for folding a blank 4". In step II, such a blank has been positioned on the support surface 51 with the required corner alignment. In step III the differently dimensioned article 3" is positioned on the not yet folded blank 4". In step IV the lower tool section 5 has been rotated by 90° relative to the position shown in steps I to III of FIG. 14. In this position the cover can now be folded and closed in step V showing the folded and closed box 25". In step VI the lower tool 5 has been rotated back into its original orientation and moved to the right of a center position as seen by the viewer so that the filled, folded and closed box 25" can be discharged from the folding apparatus 1 in the direction of the arrow A".

FIG. 15 shows the packaging of two articles 3'" next to one another in a box that requires a different blank 4'" that is slightly larger than the blank 4 in order to accommodate two articles in one box.

The folding of the blank 4'" and the packaging of the articles 3'" take place again in the same apparatus 1 with the same lower tool section 5. However, the corner modular tool units 51' have been adjusted into positions for holding two articles 3'" next to each other on the bottom surface 20'" of the blank 4'". In step I the lower tool section 5 has been moved into a position close to the blank supply magazine BS and oriented for receiving an article 3'". In step II a blank 4'" has been positioned on the adjusted modular corner units 51' with the proper alignment of corners 79, 80. In step III one side wall has been folded and one article has been placed off-center onto the bottom 20'" of the blank 4'". In step IV the blank sections 34'", 35'", 36'" with the connector tabs 34'" and 35'" have been folded. In step V the second article 3'" is placed alongside the first article as shown. In step VI the folding of the end walls and the closing of the box is completed and the lower tool section is moved in the direction of the arrow AR for the discharge of the completed box holding two articles or stacks. The frame extension 15' has an opening below the upper tool section 6 for such discharge of the filled, folded, and closed box.

Relative to the original flat position of all sections of a blank, the individual elements are folded either by 90° or by 180°. For example, the cover is first folded up with the respective side wall by 90° and then folded again by 90° into the box closing position. As mentioned above, prior to the folding operation the blanks are held in a properly corner aligned position by means of suction cups not shown. Such suction cups or holes are connected to a source of reduced pressure and are withdrawn from contact with the finished box when the finished box is moved out of the folding and packaging apparatus. Thus, such suction cups or suction holes cannot be damaged by the removal of the completed and filled box.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for packaging articles into cartons, wherein the cartons are folded from flat blanks, said apparatus comprising a machine frame (15), a lower tool section (5) movably mounted in said machine frame below a reference plane fixed in said machine frame (15), said lower tool section (5) comprising support elements (51") defining a work support surface (51) in said machine frame for supporting a flat blank, said work support surface coinciding with said reference plane when said lower tool section (5) is in an upper position, said lower tool section (5) further comprising first tool elements (52, 53, 54) for folding blank side sections into positions extending upwardly from said reference plane, first drive means (52', 53', 54') for operating said first folding tool elements (52, 53, 54), a first upper tool section (6) mounted in said machine frame above said reference plane, said first upper tool section (6) comprising second tool elements (10) for handling blank sections to form a carton cover, at least one second upper tool section (7) mounted in said apparatus above said reference plane for fixing said blank sections to form said cartons, and wherein said lower tool section (5) further comprises four corner modular tool units (51'), each corner modular tool unit (51') comprising three of said first folding tool elements (52, 53, 54) and one of said support elements (51"), whereby four of said support elements (51") define said work support surface (51), second drive means (62, 66; 63; 65) operatively connected to said four corner modular units (51') for displacing said four corner modular units (51') toward and away from one another for accommodating blanks (4, 4') of different sizes, and further drive means coupled to said lower tool section (5) for moving said lower tool section (5) into different positions in said machine frame (15).

2. The apparatus of claim 1, wherein said further drive means comprise a horizontal linear drive (71) for moving said lower tool section (5) horizontally back and forth.

3. The apparatus of claim 1, wherein said further drive means comprise a vertical linear drive (76) connected to said lower tool section (5) for elevating or lowering said lower tool section, whereby said work support surface (51) assumes different elevational levels in said machine frame.

4. The apparatus of claim 1, wherein said further drive means comprise a rotation drive (77, 78) for rotating said lower tool section (5) about an axis (72') extending perpendicularly to said work support surface (51) formed by said support elements (51") of said four corner modular units (51').

5. The apparatus of claim 1, wherein said lower tool section (5) comprises support bars (67, 68) arranged in a crosswise configuration forming four quadrants so that each of said four corner modular units (51') is positioned in one of said four quadrants, and wherein said support bars have upwardly facing surfaces positioned in a plane defined by said support elements (51") for forming part of said work support surfaces (51) with said support elements (51").

6. The apparatus of claim 1, wherein said first folding tool elements (52, 53, 54) are folding flaps, and wherein said first drive means (52', 53', 54') are connected for driving said folding flaps so that at least two folding flaps are operable in unison and at least one of said two folding flaps is additionally operable independently of the other folding flap of a pair of folding flaps.

7. The apparatus of claim 1, wherein said lower tool section (5) comprises two longitudinal guides (58, 60) arranged in parallel to each other, and two cross guides (59, 61) also arranged in parallel to each other and crosswise to said longitudinal guides (58, 60), each of said four modular units (51') comprising a slide (57) for riding on said guides.

8.The apparatus of claim 7, wherein said second drive means comprise a drive motor (65) and a drive spindle (63, 63') driven by said drive motor (65) for displacing said corner modular units (51') in a longitudinal direction, a further drive motor (66) and a further drive spindle (62, 62') driven by said further drive motor (66) for displacing said corner modular units (51') in a direction extending orthogonally to said longitudinal direction.

9. The apparatus of claim 8, wherein said drive spindle (63, 63') and said further drive spindle (62, 62') are arranged in a crossover relationship relative to each other, said apparatus further comprising first couplings (DB3, DB4) operatively connecting said drive spindle (62, 62') to said longitudinal guides (58, 60) and further couplings (DB1, DB2) operatively connecting said further drive spindle (63, 63') to said cross guides (59, 61), whereby said longitudinal guides (58, 60) are movable toward each other and away from each other, and whereby said cross guides (59, 61) are movable toward each other and away from each other.

10. The apparatus of claim 1, further comprising a slide bed (50) on which said lower tool section (5) is horizontally and movably supported.

11. The apparatus of claim 1, wherein said second upper tool section (7) comprises an adhesive applicator, and means (82) mounted to said machine frame (15') for movably supporting said adhesive applicator (7).

12. The apparatus of claim 11, wherein said adhesive applicator (7) comprises at least one adhesive dispensing nozzle (7'), and wherein said means (82) for movably supporting said adhesive applicator permit moving said adhesive dispenser nozzle (7') up or down and toward and away from said carton (9) for finishing said carton (9).

13. The apparatus of claim 1, wherein said upper first tool section (6) comprises two half sections (10) each comprising position adjustable folding flaps (95, 96, 97) and fourth drive means (99, 100, 101) for moving said folding flaps (95, 96, 97) toward each other and away from each other above said work support surface (51) for folding cover sections of said blank.

14. The apparatus of claim 13, further comprising for each of said two half sections (10) a carrier arm (92) for said folding flaps and for said fourth drive means (99, 100, 101), and fifth drive means (94) for tilting said carrier arms (92) about a horizontal axis back and forth between an upper rest position and a lower working position.

15. The apparatus of claim 14, wherein said fifth drive means (94) press said two half sections (10) of said upper tool section (6) in said working position against said carton for finishing and closing said carton.

* * * * *

UNITED STATES PATENT AND TRADEMARK OFFICE

CERTIFICATE OF CORRECTION

PATENT NO. : 6,357,212 B1
DATED : March 19, 2002
INVENTOR(S) : Salm et al.

It is certified that error appears in the above-identified patent and that said Letters Patent is hereby corrected as shown below:

Title page,
Item [73], Assignee, after "AG", insert -- , Neuwied --.

Column 6,
Line 49, after "Fig. 2", insert -- . The --.

Column 11,
Line 39, there is no paragraph spacing after "in".
Line 40, before "Fig. 7" there is no indentation.

Signed and Sealed this

Third Day of September, 2002

*Attest:*

*Attesting Officer*

JAMES E. ROGAN
*Director of the United States Patent and Trademark Office*